US005553967A

United States Patent [19]

Uozumi

[11] Patent Number: 5,553,967

[45] Date of Patent: Sep. 10, 1996

[54] FASTENING SYSTEM FOR TRIANGULARLY SHAPED SURFACES

[75] Inventor: Sachiko Uozumi, New York, N.Y.

[73] Assignee: Geo Snap, Inc., New York, N.Y.

[21] Appl. No.: 318,078

[22] Filed: Oct. 5, 1994

[51] Int. Cl.[6] ..... A63H 33/00

[52] U.S. Cl. ..... 403/393; 403/345; 446/125

[58] Field of Search ..... 403/393, 345; 446/104, 114, 126, 125, 487

[56] References Cited

U.S. PATENT DOCUMENTS

| | | | |
|---|---|---|---|
| 3,274,728 | 9/1966 | Koch | 446/126 X |
| 3,685,863 | 8/1972 | Oetiker | 403/393 X |
| 3,901,538 | 8/1975 | Blakely . | |
| 3,944,377 | 3/1976 | Defrese . | |
| 4,080,768 | 3/1978 | Trixl | 403/393 X |
| 4,114,307 | 9/1978 | Liebeskind | 446/487 |
| 4,484,406 | 11/1984 | Matsumoto et al. | 446/487 |
| 4,676,762 | 6/1987 | Ballard | 446/104 |
| 5,022,885 | 6/1991 | Lyman | 446/125 X |
| 5,033,903 | 7/1991 | Olsson et al. . | |
| 5,098,328 | 3/1992 | Beerens | 446/125 X |
| 5,222,902 | 6/1993 | Piersch . | |

FOREIGN PATENT DOCUMENTS

| | | | |
|---|---|---|---|
| 485382 | 8/1952 | Canada | 403/393 |
| 1241043 | 8/1960 | France | 446/126 |
| 281278 | 12/1914 | Germany | 446/126 |
| 2156220 | 5/1973 | Germany | 446/125 |
| 1443285 | 7/1976 | United Kingdom | 403/393 |

*Primary Examiner*—Terry Lee Melius
*Assistant Examiner*—Christopher J. Novosad
*Attorney, Agent, or Firm*—Philip A. Gilman

[57] ABSTRACT

A fastening system for triangularly shaped surfaces is provided. Fasteners are located equidistant from the apexes of triangles formed from lines bisecting adjacent sides of the triangularly shaped surface and an apex of the triangularly shaped surface. A rotated fastener is located at the midpoint of the triangularly shaped surface. The fasteners have three bumps and possibly three dents disposed in a generally circular pattern with side walls perpendicular to the surface of the triangularly shaped surface. The rotated fastener is similar to the fasteners only rotated 60°. Two triangularly shaped surfaces may be fastened together by aligning them such that the bumps from one triangularly shaped surface are received in the spaces between adjacent bumps or dents of the other triangularly shaped surface and are held closely by friction between the side walls. The fastening system is also suitable for fastening tetrahedrons or other solids having triangularly shaped surfaces.

10 Claims, 6 Drawing Sheets

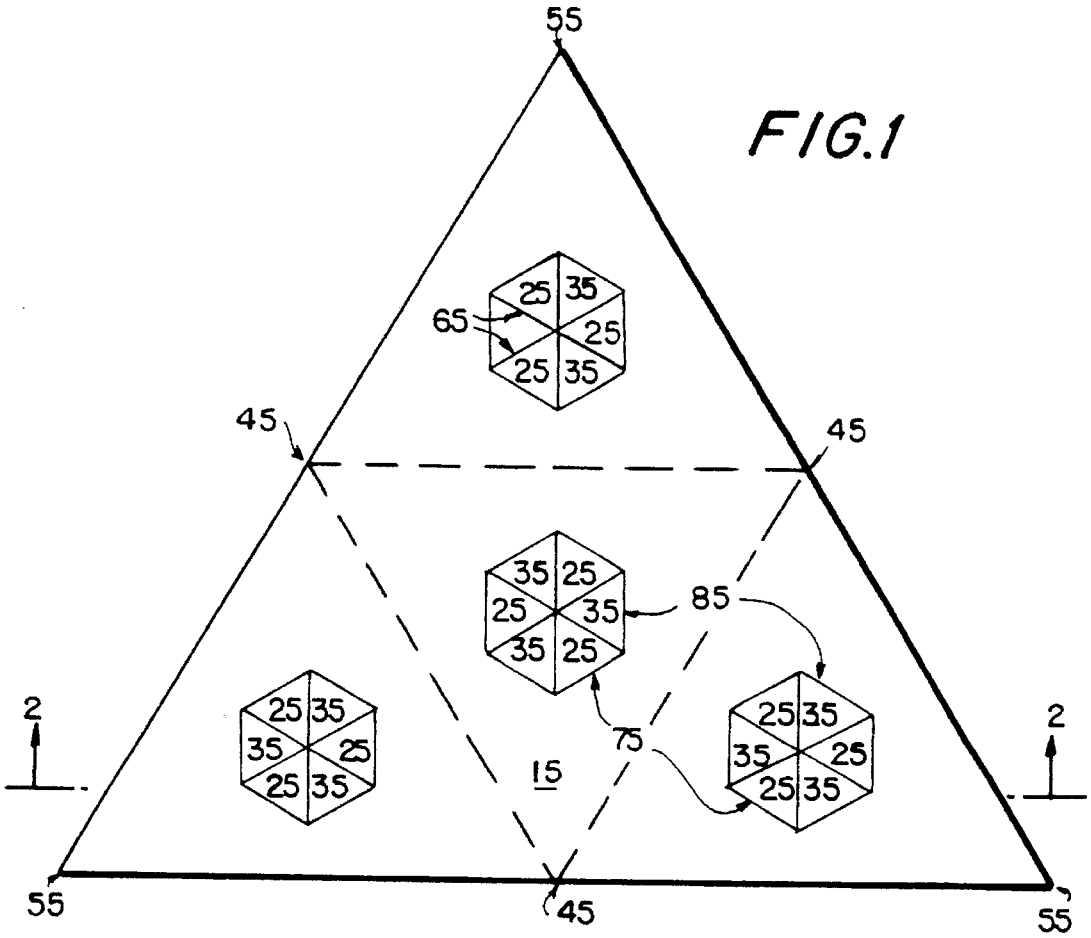
FIG.2
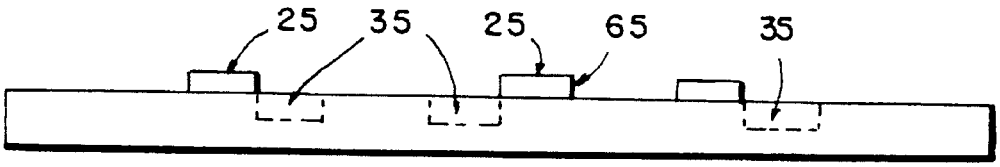

FIG. 11
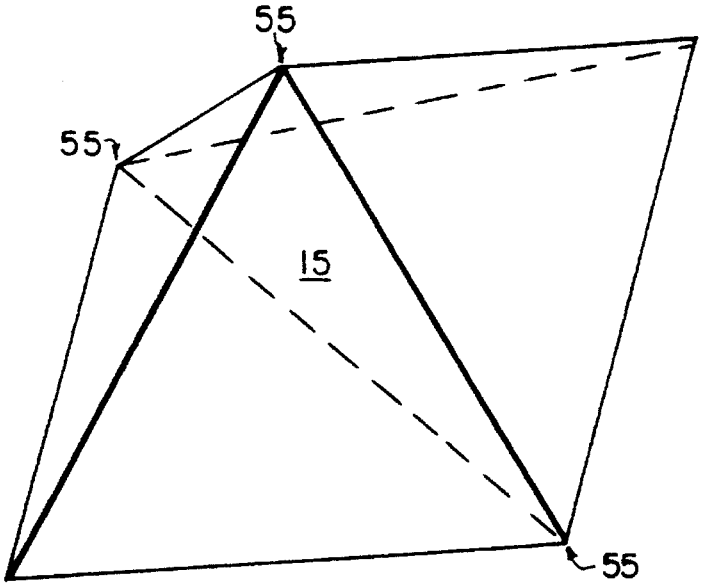
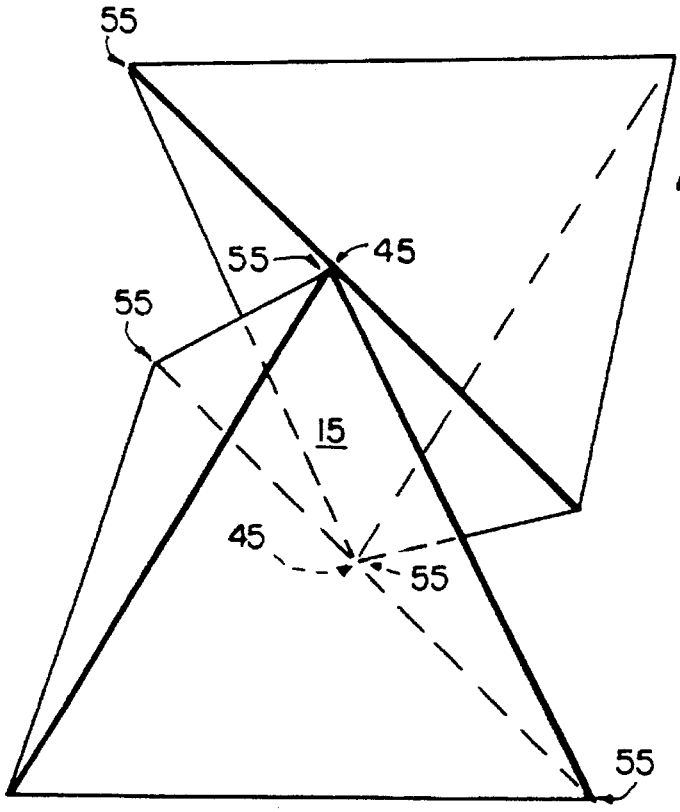
FIG. 12

FASTENING SYSTEM FOR TRIANGULARLY SHAPED SURFACES

BACKGROUND OF THE INVENTION

This invention relates to a system for fastening triangularly shaped surfaces, and preferably equilateral triangle shaped surfaces. The fastening system forms an integrated and pleasing design element on the triangularly shaped surface and is made up of a single, repeating overall design for all triangularly shaped surfaces.

The system allows for two triangularly shaped surfaces to be fastened in more than one orientation, specifically, one orientation in which the three apexes of one triangularly shaped surface align with the three apexes of another triangularly shaped surface, another orientation in which one apex of one triangularly shaped surface aligns with the midpoint of a side of the other triangularly shaped surface and the apex opposite that side of the other triangularly shaped surface aligns with the midpoint of the side of the first triangularly shaped surface opposite its aligned apex, and an orientation in which one apex of one triangularly shaped surface is fastened to an apex of another triangularly shaped surface and either or both of the remaining two apexes are either not fastened to any triangularly shaped surface or are fastened to one apex of yet another triangularly shaped surface.

Typically, fasteners require a pair of different, interlocking surfaces, one functioning, say, as a male and the other, say, as a female. For example, the common hook and loop fastening system (such as VELCRO®) requires one surface to have a hook element (male), and another to have a loop element (female). Two surfaces with hook elements can not be fastened together, nor can two surfaces with loop elements. Furthermore, hook and loop fastening systems lack elegance as an integrated design element.

In another prior art example, LEGGO® blocks are fastened together by receiving the bumps of one surface, the male surface, into the dents formed on the reverse surface, the female surface. While the bumps and dents do create a pleasing design, this system of bumps and dents is limited in that two bump surfaces cannot be fastened together, nor can two dent surfaces. Additionally, this fastening system can fasten pairs of blocks in only basic, limited orientations.

Further examples from the prior art can be seen in, for instance, Piersch, U.S. Pat. No. 5,222,902, describing a female fastening assembly and an interlocking male fastening assembly. The fastening assemblies of Piersch, '902 lack elegance as a design element and are not adaptable to allow multiple configurations of the pieces to be fastened. Olsson, U.S. Pat. No. 5,033,903, describes two elements to be fastened by having one element provided with a bump and the other element provided with a recess. Again, the separate pieces can not be interchanged. Other references describe improvements to fasteners with separate male and female members, such as Blakely, U.S. Pat. No. 3,901,538 (for quickly fastening a male and female fastener) and DeFrese U.S. Pat. No. 3,944,377 (for fastening a male and female member at a selected angle). Each of these prior fasteners have separate male and female fastening elements as well as other deficiencies.

What is desired is a fastening system in which opposing surfaces are composed of a single, pleasing, unisex design. What is further desired is a fastening system that allows for triangularly shaped surfaces to be joined in various interesting orientations, such as, at the least, three apex to three apex orientation, one apex to one midpoint orientation, and one apex to one apex orientation. What is further desired is a fastening system usefull for fastening the sides of tetrahedral solid blocks or other solid blocks in which some or all the sides are triangularly shaped, in various interesting orientations, such as, at the least, three apex to three apex orientation, one apex to one midpoint orientation, and one apex to one apex orientation.

SUMMARY OF THE INVENTION

This fastening system satisfies the above needs. A system for fastening triangularly shaped surfaces is provided. The triangularly shaped surface is preferably an equilateral triangle. The system is comprised of unisex fasteners of a single design for each triangularly shaped surface. The design can be any number of pleasing shapes or patterns which are useful. The fastening system provides unisex fastening elements centered near each apex of the triangularly shaped surfaces and an identical unisex fastening element rotated 60° about its middle and located at the center of the triangularly shaped surface.

Each unisex fastening element is formed from a single, arbitrary, yet pleasing design. Each unisex fastening element may be further formed from alternating bumps and dents equally spaced around the middle of the fastener such that the dents are adapted to receive the bumps. Alternatively, it is further provided that each unisex fastening element may be further formed from only bumps whereby the space between adjacent bumps is adapted to receive the bumps.

Thus, the fastening system provided may be made from a plurality of arbitrary, yet pleasing, unisex fastening elements containing bumps and dents. It is further provided that when the bumps of a first triangularly shaped surface's unisex fastening elements are received in the dents of a second triangularly shaped surface's unisex fastening elements, and the bumps from the second triangularly shaped surface's unisex fastening elements are received in the dents of the first triangularly shaped surface's unisex fastening elements, fastening of the two triangularly shaped surfaces and holding them in place by friction against the walls of the bumps and dents is accomplished.

Alternatively, the fastening system provided may be made from a plurality of arbitrary, yet pleasing, unisex fastening elements containing only bumps. It is further provided that when the bumps of a first triangularly shaped surface's unisex fastening elements are received in the spaces between the bumps of a second triangularly shaped surface's unisex fastening elements, and the bumps from the second triangularly shaped surface's unisex fastening elements are received in the spaces between the bumps of the first triangularly shaped surface's unisex fastening elements, fastening of the two triangularly shaped surfaces and holding them in place by friction against the walls of the bumps is accomplished.

Each fastening element, as stated above, may be made from a pattern of bumps and dents, or alternatively from bumps alone so long as any dents are adapted for receiving bumps, or in the alternative, any spaces between adjacent bumps are adapted for receiving bumps. The pattern is also such that upon 60° rotation of the fastening element, a symmetric, rotated fastening element is formed where bumps are replaced by dents and dents are replaced by bumps, or alternatively, bumps are replaced by spaces between bumps and the spaces between bumps are replaced by bumps. Therefore, the fastening element is designed so that it is symmetrical about its center.

The design of the fastening element is advantageously formed by subdividing the triangularly shaped surface into four sub-triangles by drawing lines between the midpoints of each side. Thus, four equivalent, preferably equilateral sub-triangles are formed, three sub-triangles, one at each apex, and one 60° rotated sub-triangle in the center of the triangularly shaped surface. Each sub-triangle is further divided by line through each apex of the sub-triangle and perpendicular to the opposite side at its mid-point. Thus, six equivalent right triangles are formed in each sub-triangle.

Then, each right triangle is a portion of the design, which portion is symmetrically repeated in each every other right triangle of each sub-triangle, and which design is reversed in the alternating right triangles between each pair of repeating right triangles within a sub-triangle. The reversed design is symetrically equivalent to the design. But where the bumps in the design are, dents, or alternatively spaces between bumps are in the reversed design; and where the dents, or alternatively the spaces between bumps are in the design, bumps are in the reversed design.

BRIEF DESCRIPTION OF THE DRAWINGS

These and other features, aspects and advantages of the present invention will become better understood with reference to the following description, appended claims, and accompanying drawings where FIG. 1 is a top plan view of the triangularly shaped surface with a preferred embodiment of the fastener shown.

FIG. 2 is a side elevation view along line 2—2 of the triangularly shaped surface of FIG. 1.

FIG. 11 is an oblique elevational perspective view of two equilateral tetrahedrons joined together at their respective triangularly shaped surfaces in three apex to three apex orientation.

FIG. 12 is an oblique elevational perspective view of two equilateral tetrahedrons joined together at their respective triangularly shaped surfaces in one apex to one midpoint orientation.

DESCRIPTION

Figure 3:
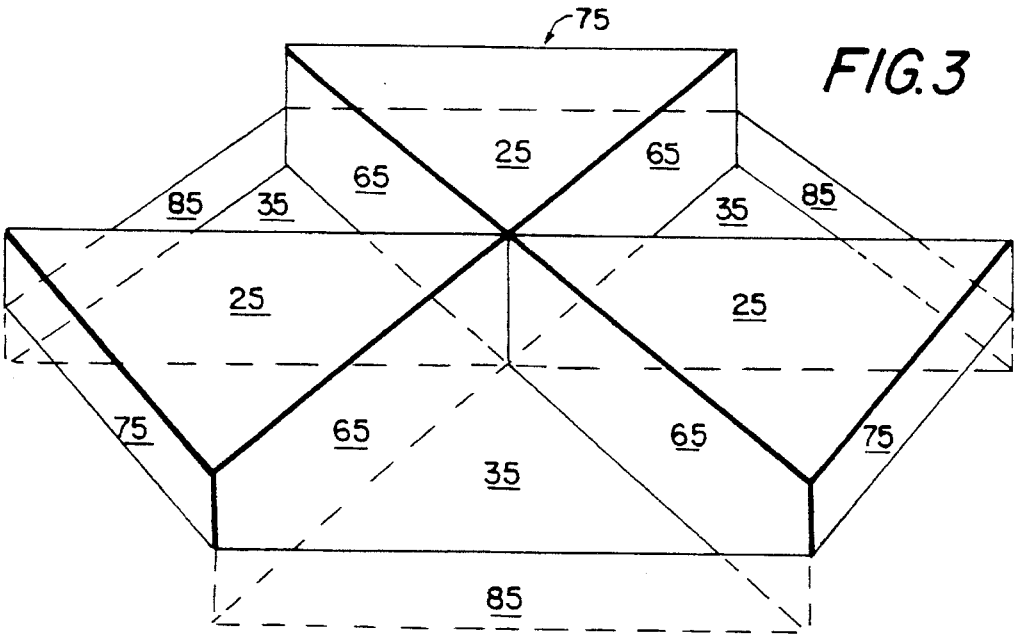
FIG. 3 is an oblique elevational perspective view of the preferred embodiment of the unisex fastening element.

The present invention is directed to a fastening system for triangularly shaped surfaces. With reference to the drawing, and especially FIGS. 1, 2 and 3, a triangularly shaped surface 15 has three unisex fasteners centered at the middle of the triangle formed by an apex 55 and a line connecting the midpoints of the two adjacent sides 45.

Each fastener is made from alternating bumps 25 and dents 35 or simply bumps 25 centered around the middle of the fastener. The dents 35 are adapted to receive the bumps 25 in a close manner or if only bumps are used, then the space between adjacent bumps is adapted to receive bumps in a close manner.

Figure 4:
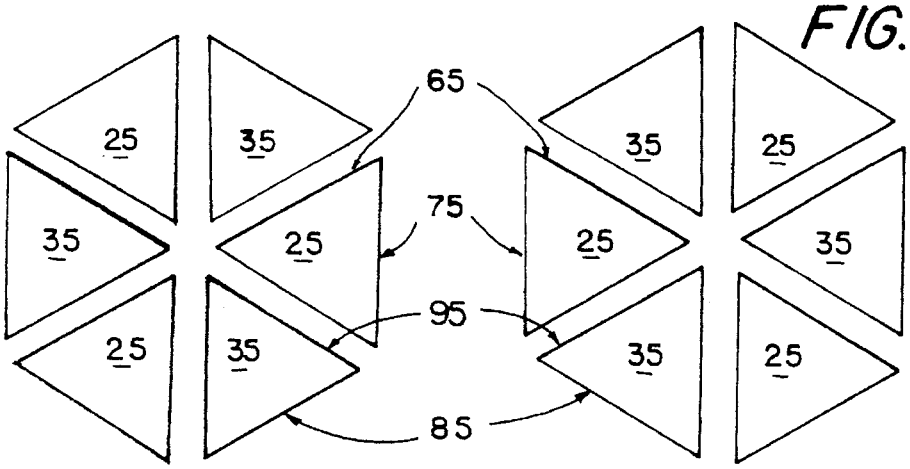
FIG. 4 is a top plan view of another design for the unisex fastener shown in normal and 60° rotated orientation.
Figure 5:
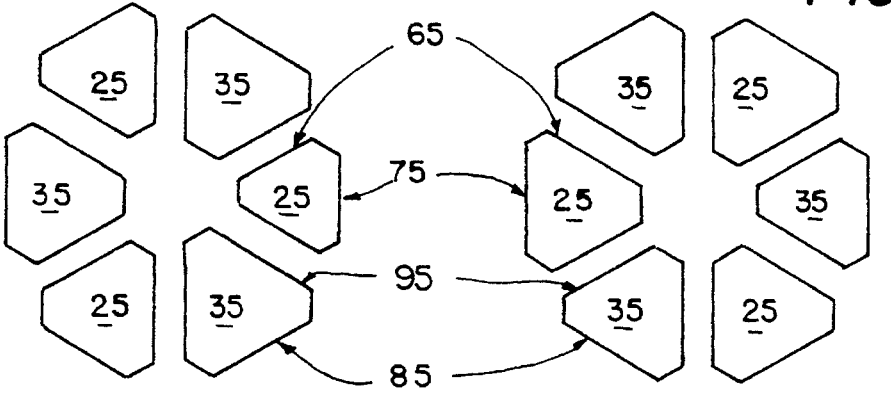
FIG. 5 is a top plan view of another design for the unisex fastener shown in normal and 60° rotated orientation.
Figure 6A:
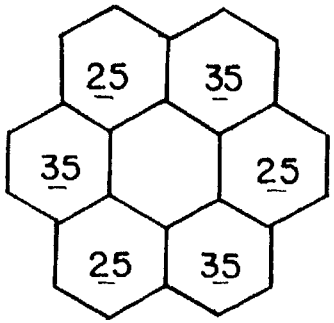
FIGS. 6A–6E are top plan views of five different designs for the unisex fastener shown in normal orientation.
Figure 6B:
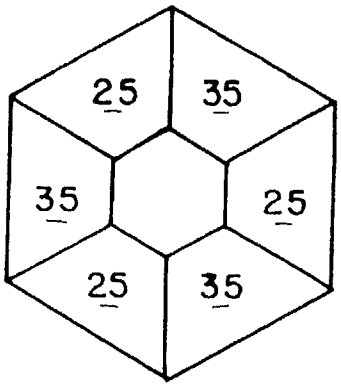
Figure 6C:
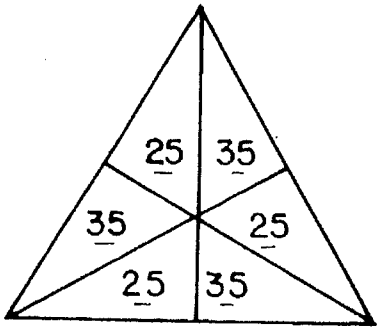
Figure 6D:
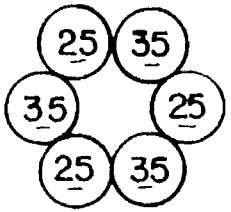
Figure 6E:
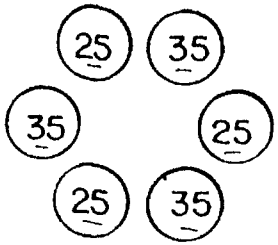

The walls of the bumps 25 and dents 35 are generally perpendicular to the triangularly shaped surface 15. The bumps 25 have side walls 65 and back walls 75. The dents also have back walls 85 and, in the preferred embodiments, have side walls that are in a plane with the side walls of the bumps 65 or may have separate side walls 95 as in FIGS. 4 and 5.

When two triangularly shaped surfaces are fastened, the bumps 25 of one may be received in the dents 35 of the other, and the bumps 25 on the other may be received in the dents 35 of the first. The side walls of the bumps 65 are held closely by friction from the side walls of the dents 95. Additional fastening strength may come from the back walls of the bumps 75 being held closely by friction from the back walls of the dents 85.

Alternatively, when two triangularly shaped surfaces 15 are fastened, the bumps 25 of one may be received in the spaces between adjacent bumps 25 of the other, and the bumps 25 on the other may be received in the spaces between adjacent bumps 25 of the first. The side walls of the bumps 65 are held closely by friction from the side walls of the other bumps 65.

Figure 8:
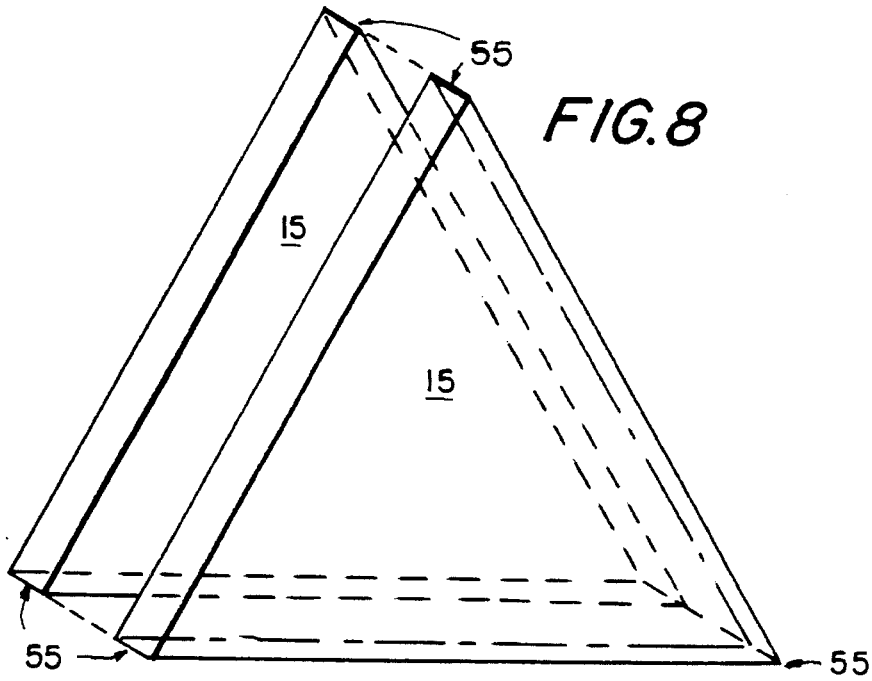
FIG. 8 is an oblique elevational perspective view of two triangularly shaped surfaces aligned three apex to three apex.
Figure 9:
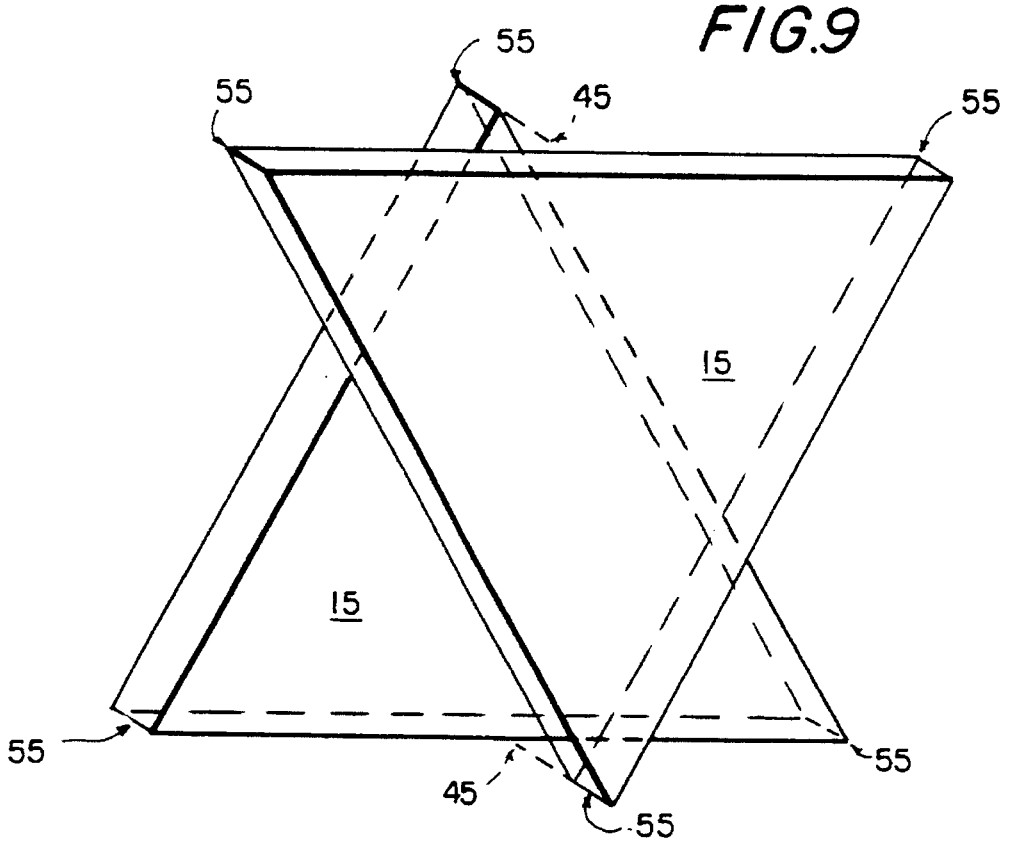
FIG. 9 is an oblique elevational perspective view of two triangularly shaped surfaces aligned one apex to one mid-point.
Figure 10:
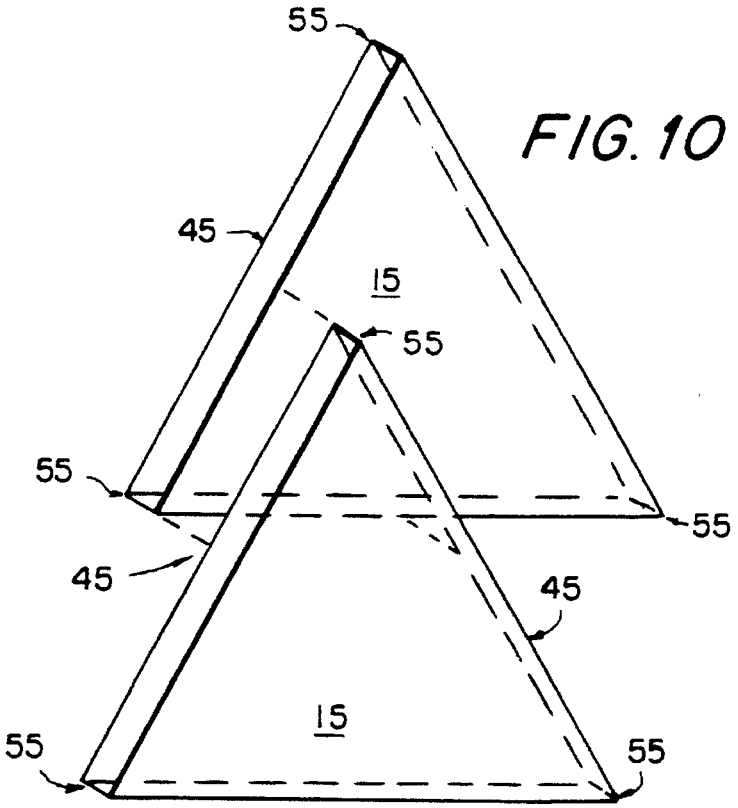
FIG. 10 is an oblique elevational perspective view of two triangularly shaped surfaces aligned one apex to one apex.

The two triangularly shaped surfaces 15 can be joined in two orientations, as in FIGS. 8 and 9. In FIG. 8, each fastener of one triangularly shaped surface 15 is aligned with a fastener on the other triangularly shaped surface 15 and the rotated fasteners of both triangularly shaped surfaces 15 are also aligned. This forms a three apex 55 to three apex 55 orientation.

In FIG. 9, a fastener of one triangularly shaped surface 15 is aligned with a rotated fastener of the other triangularly shaped surface 15 and the rotated fastener of the other triangularly shaped surface 15 is aligned with a fastener of the first triangularly shaped surface 15. This forms a one apex 55 to one midpoint 45 of the opposite side orientation.

The shape of the bumps 25 and dents 35 can be arbitrary so long as when the fastener is rotated 60° around its middle the resulting rotated fastener has bumps 25 where the fastener had dents 35 and the rotated fastener has dents 35 where the fastener had bumps 25. FIG. 6 shows five different arbitrary shapes for the fasteners that satisfy this requirement, although many others can be imagined.

Figure 7:
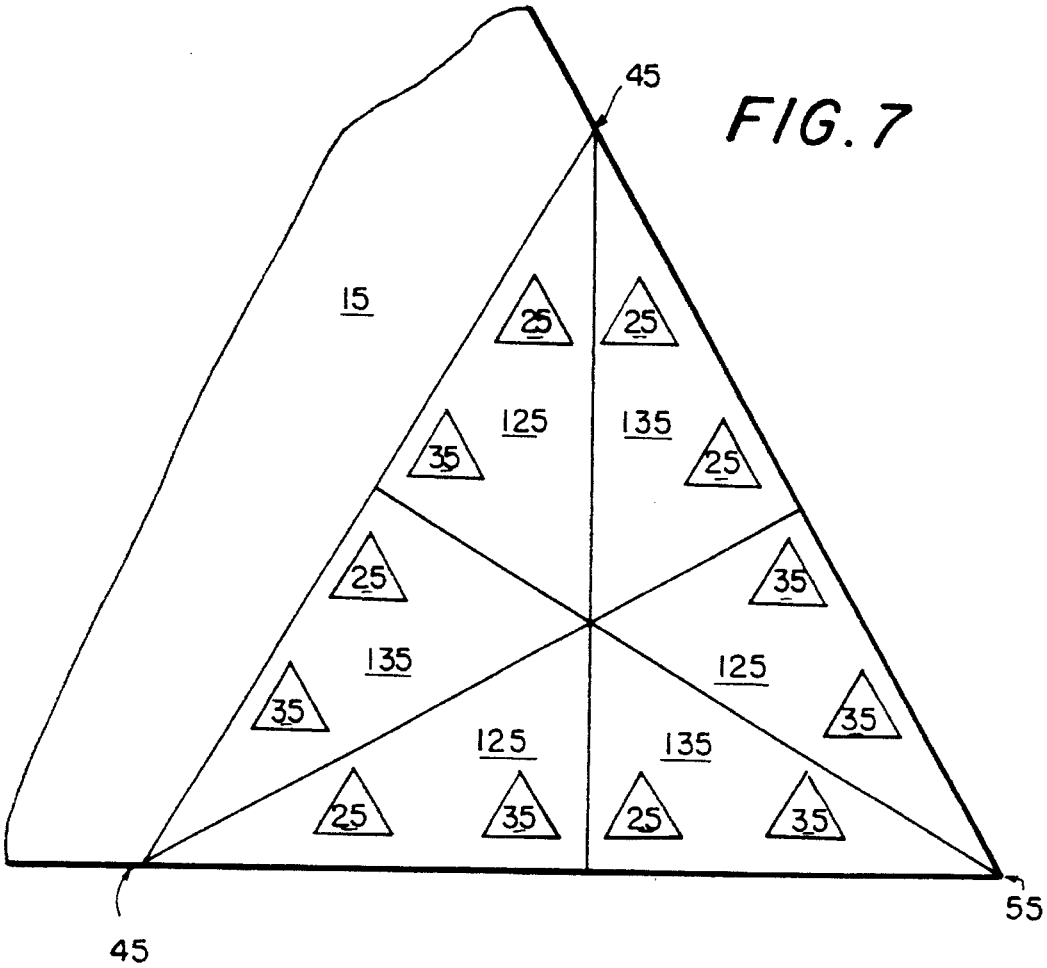
FIG. 7 is a top plan view of one fastening element showing how the design elements may be symmetrical.

With reference to FIG. 7, each fastening element may be a portion, or the entirety of a sub-triangle formed by lines connecting each mid point 45 of the triangularly shaped surface 15. The design for the fastening element is advantageously formed by dividing the sub-triangle into six right triangles by lines from each apex of the sub-triangle through and perpendicular to the mid-point of the opposite side. Then, the portion of the design of each fastening element contained in an original right triangle 125 is equivalently repeated in each every other right triangle 125 such that in each every other right triangle 125 the portion of the design element is repeated and in the adjacent right triangles 135 the portion of the design element is such that where bumps 25 are in the original right triangle 125, dents 35 are in the adjacent right triangle 135. Alternatively, the portion of the design element in the original right triangle 125 is such that in adjacent right triangles 135, a space adapted for receiving the bumps 25 is formed.

With referance to FIGS. 11 and 12, one particularly pleasing use for the Fastening System of this invention is on the surfaces of equilateral tetrahedrons. This allows a plurality of equilateral tetrahedrons to be joined in either three apex 55 to three apex 55 or one apex 55 to one midpoint 45 orientation. By using more than two equilateral tetrahedrons, a variety of pleasing, architecturally interesting shapes may be constructed.

What is claimed is:

1. A fastening system for triangularly shaped surfaces comprising:

a triangularly shaped surface;

three apex fasteners on the triangularly shaped surface, one each located in each of the three sub-triangles formed by lines bisecting the three sides of the triangularly shaped surface and having an apex corresponding to an apex of the triangularly shaped surface and each one located equidistant from the apexes of the sub-triangle formed from the lines bisecting adjacent sides of the triangularly shaped surface and having an apex corresponding to the apex of the triangularly shaped surface formed from the adjacent sides;

said apex fasteners each having three bumps, said bumps having side walls perpendicular to the surface of the triangularly shaped surface;

said apex fasteners each having three dents, said dents having side walls perpendicular to the surface of the triangularly shaped surface, said dents being adapted to receive the bumps in a close manner;

said bumps and dents of said apex fasteners disposed in a generally circular pattern such that each bump is adjacent to two dents, and each dent is adjacent to two bumps;

a center fastener located at a point equidistant from the apexes of the triangularly shaped surface;

said center fastener having three bumps; said bumps having side walls perpendicular to the surface of the triangularly shaped surface;

said center fastener having three dents, said dents being adapted to receive the bumps in a close manner;

said bumps and dents of said center fastener disposed in a generally circular pattern such that each bump is adjacent to two dents, and each dent is adjacent to two bumps;

said center fastener being similar to the apex fasteners only when said center fastener is rotated 60° relative to the orientation of the apex fasteners such that where the bumps in the apex fasteners are, there are dents in the center fastener, and where the dents in the apex fasteners are, there are bumps in the center fastener;

so that two triangularly shaped surfaces may be fastened together by aligning them such that the bumps from either an apex fastener or a center fastener on one triangularly shaped surface are received in the dents of either an apex fastener or a center fastener on the other triangularly shaped surface and held closely by friction along the side walls, whereby the two triangularly shaped surfaces may be joined with the three apex fasteners and the center fastener of one triangularly shaped surface fastened to the three apex fasteners and the center fastener, respectively, of the other triangularly shaped surface, or with only one apex fastener of one triangularly shaped surface fastened to one apex fastener of the other triangularly shaped surface, or with only one apex fastener and the center fastener of one triangularly shaped surface fastened to the center fastener and one apex fastener, respectively, of the other triangularly shaped surface.

2. The fastening system for triangularly shaped surfaces of claim 1 wherein the bumps and dents are triangularly shaped.

3. The fastening system for triangularly shaped surfaces of claim 2 wherein the side walls of the bumps adjacent to the dents are coplaner with the side walls of the dents.

4. The fastening system for triangularly shaped surfaces of claim 1 wherein the bumps and dents are hexagonally shaped.

5. The fastening system for triangularly shaped surfaces of claim 1 wherein the bumps and dents are circularly shaped.

6. A fastening system for triangularly shaped surfaces comprising:

a triangularly shaped surface;

three apex fasteners on the triangularly shaped surface, one each located in each of the three sub-triangles formed by lines bisecting the three sides of the triangularly shaped surface and having an apex corresponding to an apex of the triangularly shapes surface and each one located equidistant from the apexes of the sub-triangle formed from the lines bisecting adjacent sides of the triangularly shaped surface and having an apex corresponding to the apex of the triangularly shaped surface formed from the adjacent sides;

said apex fasteners each having three bumps, said bumps having side walls perpendicular to the surface of the triangularly shaped surface;

said bumps disposed in a generally circular pattern such that each bump is adjacent to two other bumps with a space therebetween;

said adjacent bumps having the space therebetween adapted to receive bumps in a close manner;

a center fastener located at a point equidistant from the apexes of the triangularly shaped surface;

said center fastener having three bumps, said bumps having side walls perpendicular to the surface of the triangularly shaped surface;

said bumps disposed in a generally circular pattern such that each bump is adjacent to two other bumps with a space therebetween;

said adjacent bumps having the space therebetween adapted to receive bumps in a close manner;

said center fastener being similar to the apex fasteners only when said center fastener is rotated 60° relative to the orientation of the apex fasteners such that where the bumps in the apex fasteners are, there are the spaces therebetween adapted for receiving bumps in the center fastener, and where the spaces therebetween adjacent bumps adapted for receiving bumps in the apex fasteners are, there are bumps in the center fastener;

so that two triangularly shaped surfaces may be fastened together by aligning them such that the bumps from either an apex fastener or a center fastener on one triangularly shaped surface are received in the spaces therebetween adjacent bumps adapted for receiving bumps of either an apex fastener or a center fastener on the other triangularly shaped surface and held closely by friction along the side walls, whereby the two triangularly shaped surfaces may be joined with the three apex fasteners and the center fastener of one triangularly shaped surface fastened to the three apex fasteners and the center fastener, respectively, of the other triangularly shaped surface, or with only one apex fastener of one triangularly shaped surface fastened to one apex fastener of the other triangularly shaped surface, or with only one apex fastener and the center fastener of one triangularly shaped surface fastened to the center fastener and one apex fastener, respectively, of the other triangularly shaped surface.

7. The fastening system for triangularly shaped surfaces of claim 6 wherein the bumps are triangularly shaped.

8. The fastening system for triangularly shaped surfaces of claim 6 wherein the bumps are hexagonally shaped.

9. The fastening system for triangularly shaped surfaces of claim 6 wherein the bumps are circularly shaped.

10. The fastening system for triangularly shaped surfaces of claims 1 through 9 wherein the triangularly shaped surface is an equilateral triangle.

* * * * *